US007367399B2

(12) United States Patent
Steele et al.

(10) Patent No.: US 7,367,399 B2
(45) **Date of Patent: *May 6, 2008**

(54) LOOP SYSTEMS AND METHODS OF USING THE SAME FOR CONVEYING AND DISTRIBUTING THERMAL ENERGY INTO A WELLBORE

(75) Inventors: David Joe Steele, Irving, TX (US); Jody R. McGlothen, Waxahachie, TX (US); Russell Irving Bayh, III, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/534,172

(22) Filed: Sep. 21, 2006

(65) Prior Publication Data

US 2007/0017677 A1 Jan. 25, 2007

Related U.S. Application Data

(62) Division of application No. 10/680,901, filed on Oct. 6, 2003, now Pat. No. 7,147,057.

(51) Int. Cl.
*E21B 43/24* (2006.01)

(52) U.S. Cl. ..... 166/303; 166/57; 166/272.7

(58) Field of Classification Search ..... 166/302, 166/303, 305.1, 50, 272.6, 52, 272.7, 57, 166/272.1

See application file for complete search history.

(56) References Cited

U.S. PATENT DOCUMENTS 2,911,047 A 11/1959 Henderson
3,338,306 A * 8/1967 Cook ..... 166/302

(Continued)

FOREIGN PATENT DOCUMENTS

EP 0 697 315 A2 2/1996

(Continued)

OTHER PUBLICATIONS

Andersen, A., et al, "Feasibility Study of Shape Memory Alloys In Oil Well Applications," Sintef Petroleum Research, Jan. 1997, pp. 1-5, 58, 60, 63 66-67, 83, 85-86.

(Continued)

*Primary Examiner*—Hoang Dang
(74) *Attorney, Agent, or Firm*—Rodney Carroll

(57) ABSTRACT

Systems and methods are provided for treating a wellbore using a loop system to heat oil in a subterranean formation contacted by the wellbore. The loop system comprises a loop that conveys a fluid (e.g., steam) down the wellbore via a injection conduit and returns fluid (e.g., condensate) from the wellbore via a return conduit. A portion of the fluid in the loop system may be injected into the subterranean formation using one or more valves disposed in the loop system. Alternatively, only heat and not fluid may be transferred from the loop system into the subterranean formation. The fluid returned from the wellbore may be re-heated and re-conveyed by the loop system into the wellbore. Heating the oil residing in the subterranean formation reduces the viscosity of the oil so that it may be recovered more easily.

21 Claims, 6 Drawing Sheets

U.S. PATENT DOCUMENTS

| | | | | | |
|---|---|---|---|---|---|
| 3,420,302 | A | | 1/1969 | Edwards | |
| 3,456,722 | A | | 7/1969 | Cornelius | |
| 3,493,050 | A | | 2/1970 | Kelley et al. | |
| 3,583,488 | A | * | 6/1971 | Hutchison | 166/303 |
| 3,809,159 | A | * | 5/1974 | Young et al. | 166/258 |
| 3,908,763 | A | | 9/1975 | Chapman | |
| 3,994,340 | A | | 11/1976 | Anderson et al. | |
| 3,994,341 | A | | 11/1976 | Anderson et al. | |
| 4,020,901 | A | | 5/1977 | Pisio et al. | |
| 4,099,570 | A | * | 7/1978 | Vandergrift | 166/303 |
| 4,120,357 | A | | 10/1978 | Anderson | |
| 4,209,065 | A | | 6/1980 | Ledent | |
| 4,248,376 | A | | 2/1981 | Föller | |
| 4,344,485 | A | | 8/1982 | Butler | |
| 4,364,232 | A | * | 12/1982 | Sheinbaum | 60/641.2 |
| 4,463,988 | A | | 8/1984 | Bouck et al. | |
| 4,619,320 | A | | 10/1986 | Adnyana et al. | |
| 4,641,710 | A | | 2/1987 | Klinger | |
| 4,678,039 | A | * | 7/1987 | Rivas et al. | 166/303 |
| 4,696,345 | A | * | 9/1987 | Hsueh | 166/245 |
| 4,765,410 | A | * | 8/1988 | Rogers et al. | 166/303 |
| 5,085,275 | A | | 2/1992 | Gondouin | |
| 5,148,869 | A | * | 9/1992 | Sanchez | 166/303 |
| 5,199,497 | A | | 4/1993 | Ross | |
| 5,211,240 | A | * | 5/1993 | Gadelle et al. | 166/303 |
| 5,215,146 | A | | 6/1993 | Sanchez | |
| 5,280,874 | A | | 1/1994 | Zink et al. | |
| 5,318,124 | A | | 6/1994 | Ong et al. | |
| 5,607,018 | A | * | 3/1997 | Schuh | 166/303 |
| 5,613,634 | A | | 3/1997 | Veronesi et al. | |
| 5,860,475 | A | | 1/1999 | Ejiogu et al. | |
| 5,957,202 | A | | 9/1999 | Huang | |
| 6,016,868 | A | * | 1/2000 | Gregoli et al. | 166/261 |
| 6,053,992 | A | | 4/2000 | Wu et al. | |
| 6,173,775 | B1 | * | 1/2001 | Elias et al. | 166/272.3 |
| 6,257,334 | B1 | | 7/2001 | Cyr et al. | |
| 6,433,991 | B1 | | 8/2002 | Deaton et al. | |
| 6,478,090 | B2 | | 11/2002 | Deaton | |
| 6,588,500 | B2 | | 7/2003 | Lewis | |
| 6,607,036 | B2 | | 8/2003 | Ranson et al. | |
| 6,622,794 | B2 | | 9/2003 | Zisk, Jr. | |
| 6,662,872 | B2 | | 12/2003 | Gutek et al. | |
| 6,708,763 | B2 | * | 3/2004 | Howard et al. | 166/303 |
| 6,868,903 | B2 | | 3/2005 | Mitchell et al. | |
| 6,973,973 | B2 | | 12/2005 | Howard et al. | |
| 7,066,254 | B2 | | 6/2006 | Vinegar et al. | |
| 7,147,057 | B2 | | 12/2006 | Steele et al. | |

FOREIGN PATENT DOCUMENTS

| | | |
|---|---|---|
| EP | 0 697 315 A3 | 4/1998 |
| EP | 0 841 510 A1 | 5/1998 |
| EP | 0 841 510 B1 | 1/2002 |
| GB | 2 371 578 A | 7/2002 |
| GB | 2 385 078 A | 8/2003 |

OTHER PUBLICATIONS

"Design of Fluid Systems, Steam Utilization," Spirax Sarco, 1951, pp. 1-8, 21-27, 68-71.

Doan, L.T., et al, "Performance of the SAGD Process in the Presence of Water Sand- A Preliminary Investigation," Journal of Canadian Petroleum Technology, Jan. 2003, vol. 42, No. 1, pp. 25-41.

Erlandsen, Sigurd, et al, "World's First Multiple Fiber Optic Intelligent Well," World Oil, Mar. 2003, vol. 224, No. 3, 8 pages.

Figure 9, Typical Steam Circuit, "Design of Fluid Systems: Steam Utilization," Spirax Sarco, Copyright 1985, p. 11.

Nasr, T.N., et al, "Novel Expanding Solvent-SAGD Process ES-SAGD," Journal of Canadian Petroleum Technology, Technical Note, 4 pages.

Nasr, T.N., et al, "SAGD Application In Gas Cap and Top Water Oil Reservoir," Journal of Canadian Petroleum Technology, Jan. 6, 2003, pp. 32-38.

Polma, J., et al, "Thermal Horizontal Completions Boost Heavy Oil Production," World Oil, Feb. 2003, pp. 83-85.

Total Canada- Request for Proposal- SAGD Steam Diversion Systems, Methods, and Cost Estimate, 3 pages.

Walls, E., et al, "Residual Oil Saturation Inside the Steam Chamber During SAGD," Journal of Canadian Petroleum Technology, Jan. 2003, vol. 42, No. 1, pp. 39-47.

http://www.conocophillips.com/canada/news/032502.sub.—gas.sub.—bitumen.a- sp, Oct. 1, 2003, 2 pages.

http://www.conocophillips.com/canada/ops/surmont.asp, Oct. 1, 2003, 2 pages.

Fluid Injection into Tight Rocks, http://www.132.175.127.176/ngotp/projects/ngotp.cfm?ProjectID=OGRT-010, Aug. 11, 2003.

P.C. McKenzie Company, "How does and Amot Thermostic Control Valve Work?" http://www.mckenziecorp.com/amot.sub.—valve.htm, Sep. 4, 2003.

Glullani, C., et al; "Flow Rate Allocation In Smart Wells"; High-Tech Wells Conference, Feb. 11-13, 2003; Gaiveston.

1995 Press Release; "Halliburton Introduces Durasleeve For Easier Shifting, Better Seal and Lower Total Costs"; http://www.halliburton.com/news/archive/1995/hesnws.sub.—100995.jsp.; 1 page.

Flow Control—Systems and Products—Sliding Sleeves; Baker Hughes; http:///www.bakerhughes.com/bot/completions/flow.sub.—control/products.sub- b.—sliding.htm.; 1 page.

Well Dynamics—Transforming Reservoirs Using SmartWell Technology, http://www.welldynamics.com/main.htm; 8 pages.

Steam Assisted Gravity Drainage (SAGD); Alberta Energy Research Institute; http://www.aerl.ab.ca/sec/suc.sub.—sto/suc.sub.—sto.sub.—001.sub.—2.c- fm; 2002, 2 pages.

In Situ Technology, http://www.energy.gov.ab.ca/com/Sands/Royalty+Info/Royalty+Related+Info/T-he+Ne, 1 page.

North American Oil Reserves 2001; Alberta Energy Research Institute, http://www.energy.gov.ab.ca/cmn/docs/Oil.sub.—Reserves.sub.—2001.pdf; 2 pages.

BlackRock Seeks Approval to Develop Orlon SAGD Project, http://www1.newswire.ca/releases/August2001/02/c6924.html.

Office Action dated May 20, 2005 for parent U.S. Appl. No. 10/680,901, filed Oct. 6, 2003 and entitled Loop Systems and Methods of Using the Same for Conveying and Distributing Thermal Energy into a Wellbore, 5 pgs.

Office Action dated Aug. 25, 2005 for parent U.S. Appl. No. 10/680,901, filed Oct. 6, 2003 and entitled Loop Systems and Methods of Using the Same for Conveying and Distributing Thermal Energy Into a Wellbore, 15 pgs.

Final Office Action dated Feb. 10, 2006 for parent U.S. Appl. No. 10/680,901, filed Oct. 6, 2003 and entitled Loop Systems and Methods of Using the Same for Conveying and Distributing Thermal Energy into a Wellbore, 11 pgs.

Advisory Action dated May 12, 2006 for parent U.S. Appl. No. 10/680,901, filed Oct. 6, 2003 and entitled Loop Systems and Methods of Using the Same for Conveying and Distributing Thermal Energy Into a Wellbore, 3 pgs.

Notice of Allowance dated Jun. 22, 2006 for parent U.S. Appl. No. 10/680,901, filed Oct. 6, 2003 and entitled Loop Systems and Methods of Using the Same for Conveying and Distributing Thermal Energy into a Wellbore. 5 pags.

* cited by examiner

LOOP SYSTEMS AND METHODS OF USING THE SAME FOR CONVEYING AND DISTRIBUTING THERMAL ENERGY INTO A WELLBORE

CROSS-REFERENCE TO RELATED APPLICATIONS

This is a Divisional Application of U.S. patent application Ser. No. 10/680,901, filed Oct. 6, 2003 now U.S. Pat. No. 7,471,057 and entitled "Loop Systems and Methods of Using the Same for Conveying and Distributing Thermal Energy into a Wellbore," which is hereby incorporated by reference herein in its entirety. The subject matter of this patent application is related to the commonly owned U.S. Pat. No. 7,032,675 issued on Apr. 25, 2006 and entitled "Thermally-Controlled Valves and Methods of Using the Same in a Well Bore," which is hereby incorporated by reference herein in its entirety.

FIELD OF THE INVENTION

This invention generally relates to the production of oil. More specifically, the invention relates to methods of using a loop system to convey and distribute thermal energy into a wellbore for the stimulation of the production of oil in an adjacent subterranean formation.

BACKGROUND OF THE INVENTION

Many reservoirs containing vast quantities of oil have been discovered in subterranean formations; however, the recovery of oil from some subterranean formations has been very difficult due to the relatively high viscosity of the oil and/or the presence of viscous tar sands in the formations. In particular, when a production well is drilled into a subterranean formation to recover oil residing therein, often little or no oil flows into the production well even if a natural or artificially induced pressure differential exits between the formation and the well. To overcome this problem, various thermal recovery techniques have been used to decrease the viscosity of the oil and/or the tar sands, thereby making the recovery of the oil easier.

One such thermal recovery technique utilizes steam to thermally stimulate viscous oil production by injecting steam into a wellbore to heat an adjacent subterranean formation. Typically, the highest demand placed on the boiler that produces the steam is at start-up when the wellhead, the casing, the tubing used to convey the steam into the wellbore, and the earth surrounding the wellbore have to be heated to the boiling point of water. Until the temperature of these elements reach the boiling point of water, at least a portion of the steam produced by the boiler condenses, reducing the quality of the steam being injected into the wellbore. The condensate present in the steam being injected into the wellbore acts as an insulator and slows down the heat transfer from the steam to the wellbore, the subterranean formation, and ultimately, the oil. As such, the oil might not be heated adequately to stimulate production of the oil. In addition, the condensate might cause water logging to occur.

Further, the steam is typically injected such that it is not evenly distributed throughout the well bore, resulting in a temperature gradient along the well bore. Areas that are hotter and colder than others, i.e., hot spots and cold spots, thus undesirably form in the subterranean formation. The cold spots lead to the formation of pockets of oil that remain immobile. Further, the hot spots allow the steam to break through the formation and pass directly to the production well, creating a path of least resistance for the flow of steam to the production well. Consequently, the steam bypasses a large portion of the oil residing in the formation, and thus fails to heat and mobilize the oil.

A need therefore exists to reduce the amount of condensate in the steam being injected into a subterranean formation and thereby improve the production of oil from the subterranean formation. It is also desirable to reduce the amount of hot spots and cold spots in the subterranean formation.

SUMMARY OF THE INVENTION

According to some embodiments, methods of treating a wellbore comprise using a loop system to heat oil in a subterranean formation contacted by the wellbore. The loop system conveys steam down the wellbore and returns condensate from the wellbore. A portion of the steam in the loop system may be injected into the subterranean formation using one or more injection devices, such as a thermally-controlled valve (TCV), disposed in the loop system. Alternatively, only heat and not steam may be transferred from a closed loop system into the subterranean formation. The condensate returned from the wellbore may be re-heated to form a portion of the steam being conveyed by the loop system into the wellbore. Heating the oil residing in the subterranean formation reduces the viscosity of the oil so that it may be recovered more easily. The oil and the condensate may be produced from a common wellbore or from different wellbores.

In some embodiments, a system for treating a wellbore comprises a steam loop disposed within the wellbore. The steam loop comprises a steam boiler coupled to a steam injection conduit coupled to a condensate recovery conduit. The steam loop may also comprise one or more injection devices, such as TCV's, in the steam injection conduit. The system for treating the wellbore may further include an oil recovery conduit for recovering oil from the wellbore. The steam loop and the oil recovery conduit may be disposed in a concurrent wellbore or in different wellbores such as steam-assisted gravity drainage (SAGD) wellbores.

In additional embodiments, methods of servicing a wellbore comprise injecting fluid into a subterranean formation contacted by the wellbore for heating the subterranean formation, wherein the wellbore comprises a plurality of heating zones.

In yet more embodiments, methods of servicing a wellbore comprise using a loop system disposed in the wellbore to controllably release fluid into a subterranean formation contacted by the wellbore for heating the subterranean formation.

DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

As used herein, a "loop system" is defined as a structural conveyance (e.g., piping, conduit, tubing, etc.) forming a flow loop and circulating material therein. In an embodiment, the loop system coveys material downhole and return all or a portion of the material back to the surface. In an embodiment, a loop system may be used in a well bore for conveying steam into a wellbore and for returning condensate from the wellbore. The steam in the wellbore heats oil in a subterranean formation contacted by the wellbore, thereby reducing the viscosity of the oil so that it may be recovered more easily. The loop system comprises a steam loop disposed in the wellbore that includes a steam boiler coupled to a steam injection conduit coupled to a condensate recovery conduit. The steam loop may optionally comprise control valves and/or injection devices for controlling the injection of the steam into the subterranean formation. When control valves are disposed in the steam loop, the loop system can automatically and/or manually be switched from a closed loop system in which some or all of the valves are closed (and thus all or substantially all of the material, e.g., water in the form of steam and/or condensate, is circulated and returned to the surface) to an injection system in which the valves are regulated to control the flow of the steam into the subterranean formation. It is understood that "subterranean formation" encompasses both areas below exposed earth or areas below earth covered by water such as sea or ocean water.

In some embodiments, the steam loop may be employed to convey (e.g., circulate and/or inject) steam into the well bore and to recover condensate from the well bore concurrent with the production of oil. In alternative embodiments, a "huff and puff" operation may be utilized in which the steam loop conveys steam into the wellbore in sequence with the production of oil. As such, heat can be transferred into the subterranean formation and oil can be recovered from the formation in different cycles. Other chemicals as deemed appropriate by those skilled in the art may also be injected into the wellbore simultaneously with or alternating with the cycling of the steam into the wellbore. It is understood that the steam used to heat the oil in the subterranean formation may be replaced with or supplemented by other heating fluids such as diesel oil, gas oil, molten sodium, and synthetic heat transfer fluids, e.g., THERMINOL 59 heat transfer fluid which is commercially available from Solutia, Inc., MARLOTHERM heat transfer fluid which is commercially available from Condea Vista Co., and SYLTHERM and DOWTHERM heat transfer fluids which are commercially available from The Dow Chemical Company.

Figure 1A:
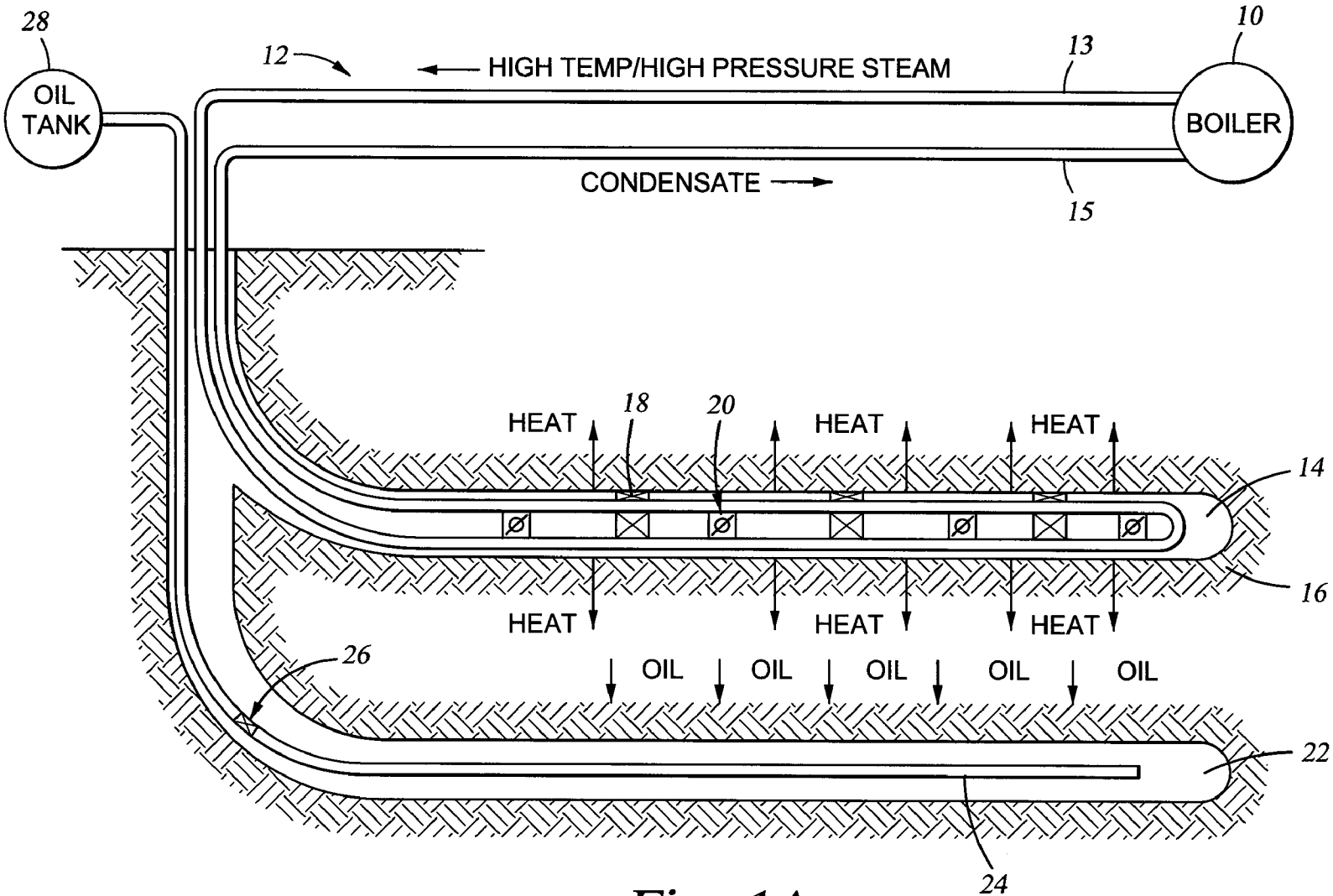
FIG. 1A depicts an embodiment of a loop system that conveys steam into a multilateral wellbore and returns condensate from the wellbore, wherein the loop system is disposed above an oil production system.

FIG. 1A illustrates an embodiment of a loop system for conveying steam into a wellbore and returning condensate from the well bore. As shown in FIG. 1A, the loop system may be employed in a multilateral configuration comprising SAGD wellbores. In this configuration, two lateral SAGD wellbores extend from a main wellbore and are arranged one above the other. Alternatively, the loop system may be employed in SAGD wellbores having an injector wellbore independent from a production wellbore. The SAGD wellbores may be arranged in parallel in various orientations such as vertically, slanted (useful at shallow depths), or horizontally, and they may be spaced sufficiently apart to allow heat flux from one to the other.

The system shown in FIG. 1A comprises a steam boiler 10 coupled to a steam loop 12 that runs from the surface of the earth and down into an upper lateral SAGD wellbore 14 that penetrates a subterranean formation 16. The steam boiler 10 is shown above the surface of the earth; however, it may alternatively be disposed underground in wellbore 14 or in a laterally enclosed space such as a depressed silo. When steam boiler 10 is disposed underground, water may be pumped down to boiler 10, and a surface heater or boiler may be used to pre-heat the water before conveying it to boiler 10. The steam boiler 10 may be any known steam boiler such as an electrical fired boiler to which electricity is supplied or an oil or natural gas fired boiler. In an alternative embodiment, steam boiler 10 may be replaced with a heater when a heating transfer medium other than steam, e.g., water, antifreeze, and/or sodium, is conveyed into wellbore 14.

The steam loop 12 further includes a steam injection conduit 13 connected to a condensate recovery conduit 15 in which a condensate pump, e.g., a downhole steam-driven pump, is disposed (not shown).

Optionally, one or more valves 20 may be disposed in steam loop 12 for injecting steam into well bore 14 such that the steam can migrate into subterranean formation 16 to heat the oil and/or tar sand therein. Each valve 20 may be disposed in separate isolated heating zones of well bore 14 as defined by isolation packers 18. The valves 20 are capable of selectively controlling the flow of steam into corresponding heating zones of subterranean formation 16 such that a uniform temperature profile may be obtained across subterranean formation 16. Consequently, the formation of hot spots and cold spots in subterranean formation 16 are avoided. Examples of suitable valves for use in steam loop 12 include, but are not limited to, thermally-controlled valves, pressure-activated valves, spring loaded-control valves, surface-controlled valves (e.g., an electrically-driven/controlled/operated valve, a hydraulically-driven/controlled/operated valve, and a fiber optic-controlled/actuated/operated valve), sub-surface controlled valves (a tool may be lowered in the wellbore to shift the valve's position), manual valves, and combinations thereof. Additional disclosure related to thermally-controlled valves and methods of using them in a wellbore can be found in U.S. Pat. No. 7,032,675 issued Apr. 25, 2006 and entitled "Thermally-Controlled Valves and Methods of Using the Same in a Well Bore."

As depicted in FIG. 1A, the loop system described above may also include a means for recovering oil from subterranean formation 16. This means for recovering oil may comprise an oil recovery conduit 24 disposed in a lower wellbore 22, for example, in a lower multilateral SAGD wellbore that penetrates subterranean formation 16. The oil recovery conduit 24 may be coupled to an oil tank 28 located above the surface of the earth or underground near the surface of the earth. The oil recovery conduit 24 comprises a pump 26 for displacing the oil from wellbore 22 to oil tank 28. Examples of suitable pumps for conveying the oil from wellbore 22 include, but are not limited to, progressive cavity pumps, jet pumps, and gas-lift, steam-powered pumps. Although not shown, various pieces of equipment may be disposed in oil recovery conduit 24 for treating the produced oil before storing it in oil tank 28. For instance, the produced oil usually contains a mixture of oil, condensate, sand, etc. Before the oil is stored, it may be treated by the use of chemicals, heat, settling tanks, etc. to let the sand fall out. Examples of equipment that may be employed for this treatment include a heater, a treater, a heater/treater, and a free-water knockout tank, all of which are known to those skilled in the art. Also, a downhole auger that may be employed to produce the sand that usually accompanies the oil and thereby prevent a production well from "sanding up" is disclosed in U.S. Pat. No. 6,868,903, issued Mar. 22, 2005 and entitled "Production Tool," which is incorporated by reference herein in its entirety.

In addition, the heat generated by the produced oil may be recovered via a heat exchanger, for example, by circulating the oil through coils of steel tubing that are immersed in a tank of water or other fluid. Further, the water being fed to boiler 10 may be pumped through another set of coils. The heat is transferred from the produced fluid into the tank water and then to the feed water coils to help heat up the feed water. Transferring the heat from the produced oil to the feed water in this manner increases the efficiency of the loop system by reducing the amount of heat that boiler 10 must produce to convert the feed water into steam. It is understood that various pieces of equipment also may be disposed in steam loop 12, wellbores 14 and 22, and subterranean formation 16 as deemed appropriate by one skilled in the art.

Although not shown, one or more valves optionally may be disposed in oil recovery conduit 24 for regulating the production of fluids from wellbore 22. Moreover, valves may be disposed in isolated heating zones of wellbore 22 as defined by isolation packers 18 and/or 29 (see FIG. 1B). The valves are capable of selectively preventing the flow of steam into oil recovery conduit 24 so that the heat from the injected steam remains in wellbore 22 and subterranean formation 16. Consequently, the heat energy remains in subterranean formation 16, which reduces the amount of energy (e.g. electricity or natural gas) required to heat boiler 10. Examples of suitable valves for use in oil recovery conduit 24 include, but are not limited to, steam traps, thermally-controlled valves, pressure-activated valves, spring loaded control valves, surface controlled valves (e.g., an electrically-driven/controlled/operated valve, a hydraulically-driven/controlled/operated valve, and a fiber optic-controlled/actuated/operated valve), sub-surface controlled valves (a tool may be lowered in the wellbore to shift the valve's position), and combinations thereof. Additional information related to the use of such valves can be found in the copending TCV application referenced previously.

Isolations packers 18 may also be arranged in wellbore 14 and/or wellbore 22 to isolate different heating zones therein. The isolation packers 18 may comprise, for example, ethylene propylene diene monomer (EPDM), perfluoroelastomer (FFKM) materials such as KALREZ perfluoroelastomer available from DuPont de Nemours & Co., CHEMRAZ perfluoroelastomer available from Greene Tweed & Co., PERLAST perfluoroelastomer available from Precision Polymer Engineering Ltd., and ISOLAST perfluoroelastomer available from John Crane Inc., polyetheretherketone (PEEK), and polyetherketoneketone (PEKK).

Figure 1B:
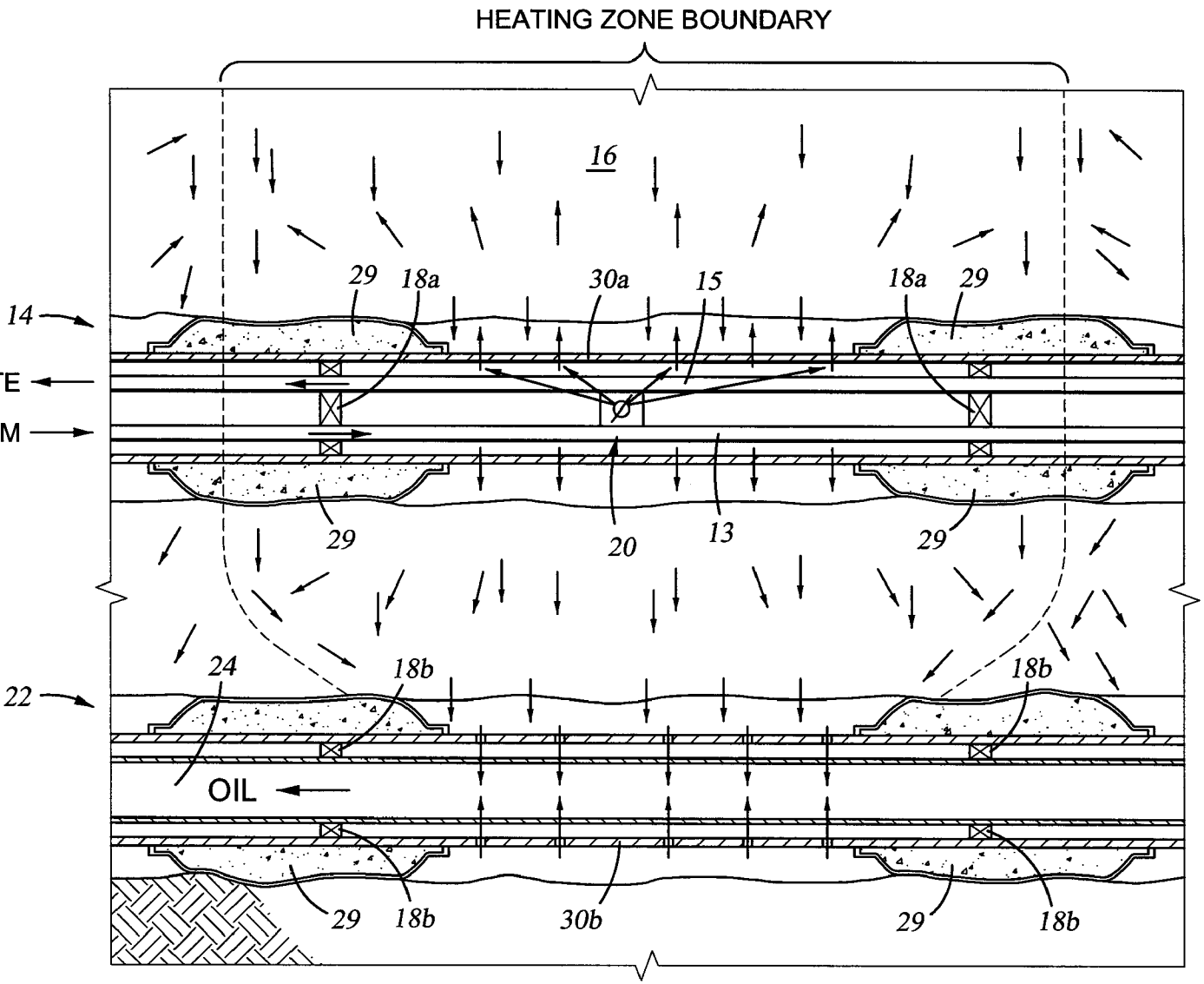
FIG. 1B depicts a detailed view of a heating zone in the loop system shown in FIG. 1A.

FIG. 1B illustrates a detailed view of an isolated heating zone in the loop system shown in FIG. 1A. As shown, dual tubing/casing isolation packers 18*a* may surround steam injection conduit 13 and condensate recovery conduit 15, thereby forming seals between those conduits and against the inside wall of a casing 30*a* (or a slotted liner, screen, the wellbore, etc.) that supports subterranean formation 16 and prevents it from collapsing into wellbore 14. The isolation packers 18*a* prevent steam from passing from one heating zone to another, allowing the steam to be transferred to corresponding heating zones of formation 16. The isolation packers 18*a* thus serve to ensure that heat is more evenly distributed throughout formation 16. Thus, isolation packers 18*a* create a heating zone in subterranean formation 16 that extends from wellbore 14 (the steam injection wellbore) to wellbore 22 (oil production wellbore) and from the top to the bottom of the oil reservoir in subterranean formation 16. In addition, isolation packers 18*a* prevent steam and other fluids (e.g., heated oil) from flowing in the annulus (or gap) between steam injection conduit 13, oil recovery conduit 24, and the inside of casing 30*a*. Isolation packers 18*b* also may surround oil recovery conduit 24, thereby forming a seal between that conduit and the inside wall of a casing 30*b* (or a slotted liner, a screen, the wellbore, etc.) that supports formation 16 and prevents it from collapsing into wellbore 22. The casing 30*b* may have holes (or slots, screens, etc.) to permit the flow of oil into oil production conduit 24. The isolation packers 18*b* prevent steam and other fluids (e.g., heated oil) from flowing in the annulus between oil recovery conduit 24 and the inside of casing 30B. Additional external casing packers 29, which may be inflated with cement, drilling mud, etc., may form a seal between the outside of casing 30*a* and the wall of wellbore 14 and between the outside of casing 30*b* and the wall of wellbore 22. Sealing the space between the outside wall of casings 30*a* and 30*b* and the wall of the wellbores 14 and 22, respectively, is necessary to prevent steam and other fluids such as heated oil from flowing from one heating zone (depicted by the Heat Zone Boundary lines) to another.

Turning back to FIG. 1A, using the loop system comprises first supplying water to steam boiler 10 to form steam having a relatively high temperature and high pressure, followed by conveying the steam produced in boiler 10 into upper wellbore 14 using steam loop 12. The steam passes from steam boiler 10 into wellbore 14 through steam injection conduit 13. Initially, the earth surrounding wellbore 14, steam injection conduit 13, valves 20, and any other structures disposed in wellbore 14 are below the temperature of the steam. As such, a portion of the steam condenses as it flows through steam injection conduit 13. The steam and the condensate may be re-circulated in steam loop 12 until a desired event occurs, e.g., the temperature of wellbore 14 is heated to at least the boiling point of water (i.e., 212° F. at atmospheric pressure). Further, the steam may be re-circulated until it is saturated or superheated such that it contains the optimum amount of heat. In an embodiment, steam loop 12 is operated during this time as a closed loop system by closing all of the valves 20. In another embodiment, all of the valves except the one farthest from the surface remain closed until a desired event occurs. Then that valve closes, and the rest of the valves open. In this embodiment, a single tubing string could be used to convey the steam downhole to the one open valve, and the wellbore casing/liner could be used to convey condensate back to the surface. The condensate could be cleaned and reused by re-heating it using a heat exchanger and/or an inexpensive boiler. Using a single tubing string may be less expensive than using multiple tubing strings with packers therebetween. Recirculating the condensate and waiting until a desired event has occurred before injecting steam into the wellbore conserves energy and thus reduces the operation costs of the loop system, such as the cost of water and fuel for the boiler. In addition, this method prevents the injection of excessive water into the formation that would eventually be produced and thus would have to be separated from the oil for disposal or re-use.

The steam loop 12 may be switched from a closed loop mode to an injection mode manually or automatically (i.e, when valves 20 are thermally-controlled valves) in response to measured or sensed parameters. For example, a downhole temperature, a temperature of the steam/condensate in wellbore 14, a temperature of the produced oil, and/or the amount of condensate could be measured, and valves 20 could be adjusted in response to such measurements. Various methods may be employed to take the measurements. For example, a fiber optic line may be run into wellbore 14 before steam injection begins. The fiber optic line has the capability of reading the temperature along every single inch of wellbore 14. In addition, hydraulic or electrical lines could be run into wellbore 14 for sensing temperatures therein. Another method may involve measuring the slight change in pH between the steam and the condensate to determine whether the steam is condensing such that the fuel consumption of boiler 10 can be controlled. A control loop (e.g., intelligent well completions or smart wells) may be utilized to implement the switching of steam loop 12 from a closed loop mode to an injection mode and vice versa.

In the injection mode, near-saturated steam may be selectively injected into the heating zones of subterranean formation 16 by controlling valves 20. Valves 20 may regulate the flow of steam into wellbore 14 based on the temperature in the corresponding heating zones of subterranean formation 16. That is, valves 20 may open or increase the flow of steam into corresponding heating zones when the temperature in those heating zones is lower than desired. However, valves 20 may close or reduce the flow of steam into corresponding heating zones when the temperature in those zones is higher than desired. The opening and closing of valves 20 may be automated or manual in response to measured or sensed parameters as described above. As such, valves 20 can be controlled to achieve a substantially uniform temperature distribution across subterranean formation 16 such that all or a substantial portion of the oil in formation 16 is heated. In an embodiment, valves 20 comprise TCV's that automatically regulate flow in response to the temperature in a given heating zone. Additional details regarding such an embodiment are disclosed in the copending TCV application referenced previously.

Further, valves 20 may comprise steam traps that allow the steam to flow into wellbore 14 while inhibiting the flow of condensate into wellbore 14. Instead, the condensate may be returned from wellbore 14 back to steam boiler 10 via condensate return conduit 15, allowing it to be re-heated to form a portion of the steam flowing into wellbore 14. The condensate may contain dissolved solids that are naturally present in the water being fed to steam boiler 10. Any scale that forms on the inside of steam injection conduit 13 and condensate return conduit 15 may be flushed from steam loop 12 by reversing the flow of the steam and condensate in steam loop 12. Other methods of scale inhibition and removal known to those skilled in the art may be used too.

Removing the condensate from steam injection conduit 13 such that it is not released with the steam into wellbore 14 reduces the possibility of experiencing water logging and improves the quality of the steam. However, after steam has been injected into wellbore 14 for some time, the area near wellbore 14 may become water logged due to a variety of reasons such as temporary shutdown of the boiler for maintenance. To overcome this problem, the loop system may be switched to the closed loop mode, wherein injection valves are closed and steam is circulated rather than injected as described in detail below. The steam may be heated to a superheated state such that a vast amount of heat is transferred into the water logged area, causing the fluids therein to become superheated and expand deep into subterranean formation 16. Other means known to those skilled in the art may also be employed to overcome the water logging problem.

The quality of the steam injected into wellbore 14 can be adjusted by controlling the steam pressure and temperature of the entire system, or the quality of the steam injected into each heating zone of subterranean formation 16 may be adjusted by changing the temperature and pressure set points of the control valves 20. Injecting a higher quality steam into wellbore 14 often provides for better heat transfer from the steam to the oil in subterranean formation 16. Further, the steam has enough stored heat to convert a portion of the condensed steam and/or flash near wellbore 14 into steam. Therefore, the amount of heat transferred from the steam to the oil in subterranean formation 16 is sufficient to render the oil mobile.

According to alternative embodiments, steam loop 12 is a closed loop that releases thermal energy but not mass into wellbore 14. The steam loop 12 either contains no control valves, or the control valves 20 are closed such that steam cannot be injected into wellbore 14. As the steam passes through steam injection conduit 13, heat may be transferred from the steam into the different zones of wellbore 14 and is further transferred into corresponding heating zones of subterranean formation 16.

In response to being heated by the steam circulated into wellbore 14, the oil residing in the adjacent subterranean formation 16 becomes less viscous such that gravity pulls it down to the lower wellbore 22 where it can be produced. Also, any tar sand present in subterranean formation becomes less viscous, allowing oil to flow into lower wellbore 22. The oil that migrates into wellbore 22 may be recovered by pumping it through oil recovery conduit 24 to oil tank 28. Optionally, released deposits such as sand may also be removed from subterranean formation 16 by pumping the deposits from wellbore 22 via oil recovery conduit 24 along with the oil. The deposits may be separated from the oil in the manner described previously.

Figure 2A:
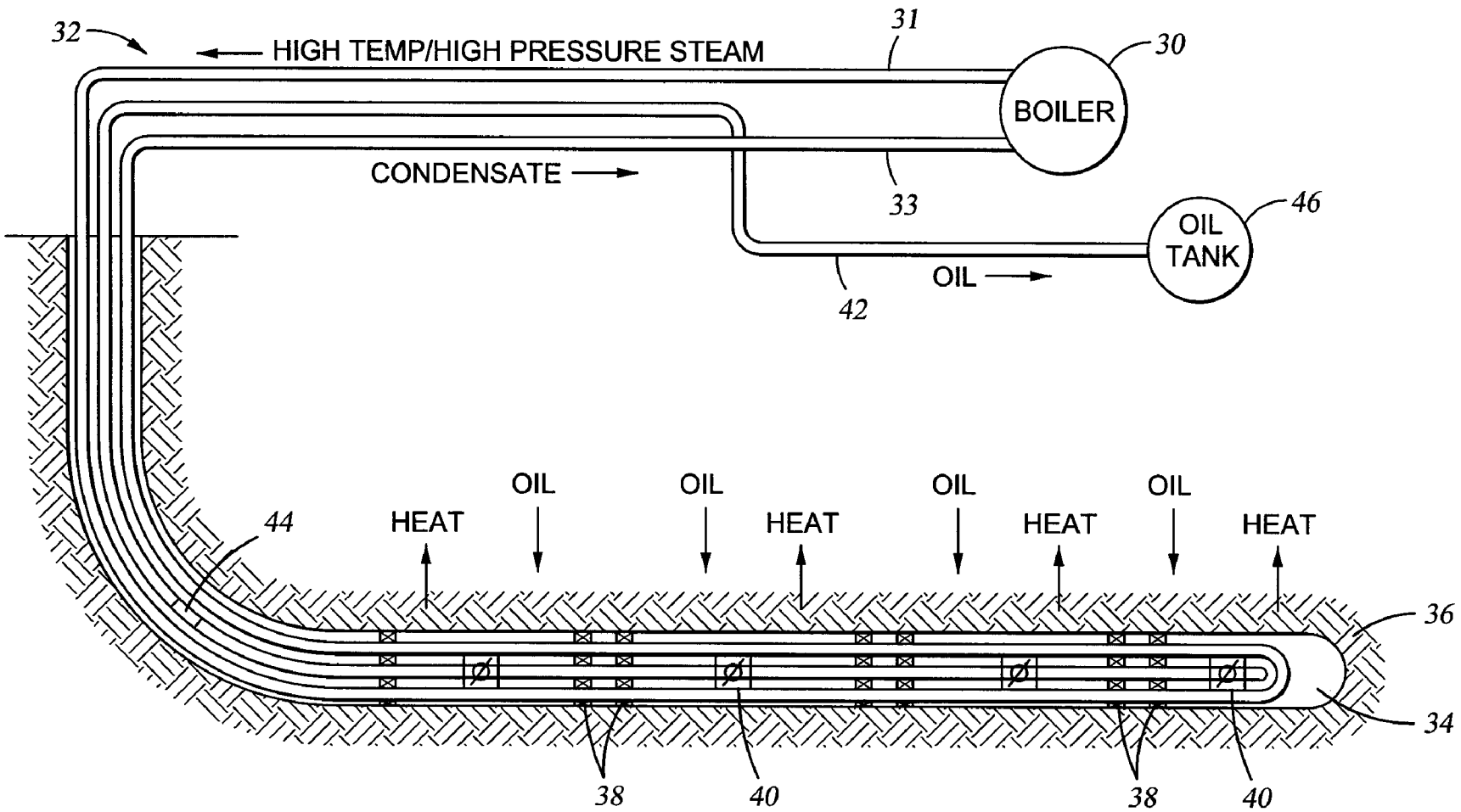
FIG. 2A depicts another embodiment of a loop system that conveys steam into a monolateral wellbore and returns condensate from the wellbore, wherein the loop system is co-disposed with an oil production system.

FIG. 2A illustrates another embodiment of a loop system similar to the one depicted in FIG. 1A except that the oil and the condensate are recovered in a common well bore. The system comprises a steam boiler 30 coupled to a steam loop 32 that runs from the surface of the earth down into wellbore 34 that penetrates a subterranean formation 36. The steam boiler 30 is shown above the surface of the earth; however, it may alternatively be disposed underground in wellbore 34 or in a laterally enclosed space such as a depressed silo. When steam boiler 30 is disposed underground, water may be pumped down to boiler 30, and a surface heater or boiler may be used to pre-heat the water before conveying it to boiler 30. The steam boiler 30 may be any known steam boiler such as an electrical fired boiler to which electricity is supplied or an oil or natural gas fired boiler. As in the embodiment shown in FIG. 1A, steam boiler 30 may be replaced with a heater.

The steam loop 32 may include a steam injection conduit 31 connected to a condensate recovery conduit 33. In addition to steam loop 32, an oil recovery conduit 42 for recovering oil from subterranean formation 36 extends from an oil tank 46 down into wellbore 34. The oil tank 46 may be disposed above or below the surface of the earth. If steam boiler 30 is disposed in wellbore 34, the water being fed to boiler 30 may be pre-heated by the oil being produced in wellbore 34. As shown, oil recovery conduit 42 may be interposed between steam injection conduit 31 and condensate recovery unit 33. It is understood that other configurations of steam loop 32 and oil recovery conduit 42 than those depicted in FIG. 2 may be employed. For example, a concentric conduit configuration, a multiple conduit configuration, and so forth may be used. A pump 44 may be disposed in oil recovery conduit 42 for displacing oil from wellbore 34 to oil tank 46. Examples of suitable pumps for conveying the oil from wellbore 34 include, but are not limited to, progressive cavity pumps, jet pumps, and gas-lift, steam-powered pumps. Although not shown, a pump, e.g., a steam powered condensate pump, also may be disposed in condensate recovery conduit 33. Like in the embodiment shown in FIG. 1, various types of equipment may be disposed in steam loop 32, oil recovery conduit 42, wellbore 34, and subterranean 36. Also, the produced oil may be hot, and it may be cooled using a heat exchanger as described in the previous embodiment.

Optionally, one or more valves 40 may be disposed in steam loop 32 for injecting steam into wellbore 34 such that the steam can migrate into subterranean formation 36 to heat the oil and/or tar sand therein. The valves 40 may be disposed in isolated heating zones of wellbore 34 as defined by isolation packers 38. The valves 40 are capable of selectively controlling the flow of steam into corresponding heating zones of subterranean formation 36 such that a more uniform temperature profile may be obtained across subterranean formation 36. Consequently, the formation of hot spots and cold spots in subterranean formation 36 are reduced. Additionally, one or more valves 40 may be disposed in oil recovery conduit 42 for regulating the production of fluids from wellbore 34. The valves 40 may be disposed in isolated heating zones of wellbore 34, as defined by isolation packers 38 and/or 39. The valves 40 are capable of selectively preventing the flow of steam into oil recovery conduit 42 so that the heat from the injected steam remains in wellbore 34 and subterranean formation 36. Consequently, the heat energy remains in the subterranean formation 36, thus reducing the amount of energy (e.g. electricity or natural gas) required to heat boiler 30. Examples of suitable valves for use in steam loop 32 and oil recovery conduit 42 include, but are not limited to, thermally-controlled valves, pressure-activated valves, spring loaded control valves, surface controlled valves (e.g., an electrically-driven/controlled/operated valve, a hydraulically-driven/controlled/operated valve, and a fiber optic-controlled/actuated/operated valve), sub-surface controlled valves (a tool may be lowered in the wellbore to shift the valve's position), and combinations thereof. Additional disclosure related to thermally-controlled valves and methods of using them in a wellbore can be found in the previously referenced copending TCV patent application.

Isolations packers 38 may also be arranged in wellbore 34 to isolate different heating zones of the wellbore. The isolation packers 38 may comprise, for example, ethylene propylene diene monomer (EPDM), perfluoroelastomer (FFKM) materials such as KALREZ perfluoroelastomer available from DuPont de Nemours & Co., CHEMRAZ perfluoroelastomer available from Greene Tweed & Co., PERLAST perfluoroelastomer available from Precision Polymer Engineering Ltd., and ISOLAST perfluoroelastomer available from John Crane Inc., polyetheretherketone (PEEK), and polyetherketoneketone (PEKK).

Figure 2B:
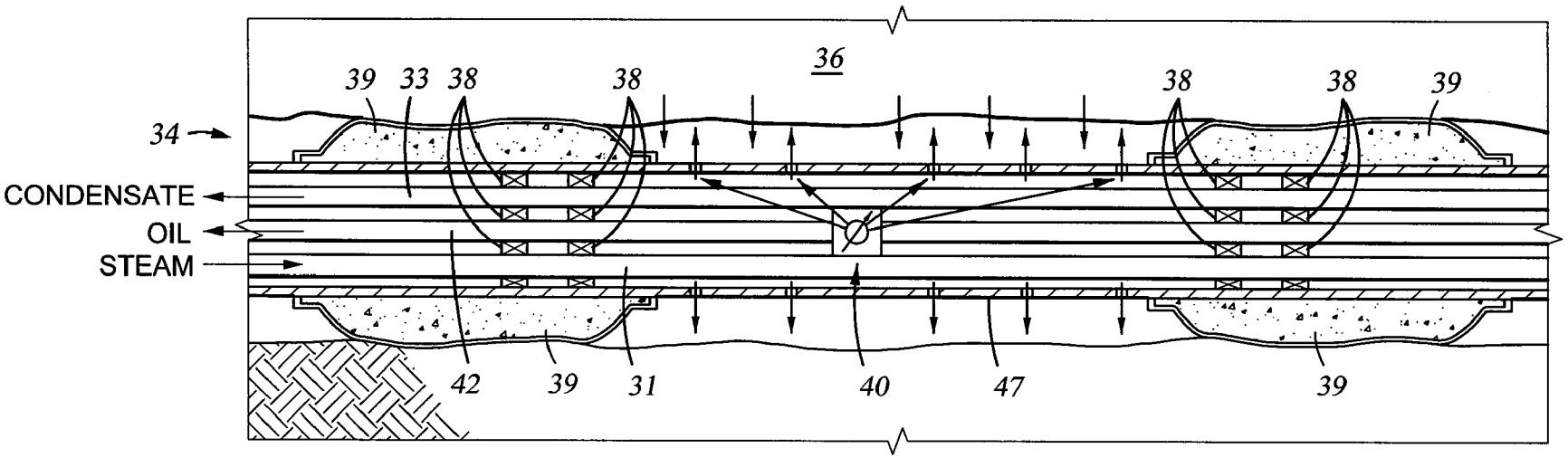
FIG. 2B depicts a detailed view of a portion of the loop system shown in FIG. 2A.

FIG. 2B illustrates a detailed view of an isolated heating zone in the loop system shown in FIG. 2A. As shown, tubing/casing isolation packers 38 may surround steam injection conduit 31, condensate recovery conduit 33, and oil recovery conduit 42, thereby forming seals between those conduits and against the inside wall of a casing 47 (or a slotted liner, cement sheath, screen, the wellbore, etc.) that supports subterranean formation 36 and prevents it from collapsing into wellbore 34. The isolation packers 38 prevent steam from passing from one heating zone to another, allowing the steam to be transferred to corresponding heating zones of formation 36. The isolation packers 38 thus serve to ensure that heat is more evenly distributed throughout formation 36. In addition, external casing packers 39, which may be inflated with cement, drilling mud, etc., may form a seal between the outside of casing 47 and the wall of wellbore 34, thus preventing steam from flowing from one heating zone to another along the wall of wellbore 34.

Using the loop system shown in FIG. 2A comprises first supplying water to steam boiler 30 to form steam having a relatively high temperature and high pressure. The steam is then conveyed into wellbore 34 using steam loop 32. The steam passes from steam boiler 30 into wellbore 34 through steam injection conduit 31. Initially, steam injection conduit 31, valves 40, and any other structures disposed in wellbore 34 are below the temperature of the steam. As such, a portion of the steam is cooled and condenses as it flows through steam injection conduit 31. The steam and the condensate may be re-circulated in steam loop 32 until a desired event has occurred, e.g., the temperature of wellbore 34 has heated up to at least the boiling point of water (i.e., 212° F. at atmospheric pressure). Further, the steam may be re-circulated until it is saturated or superheated such that it contains the optimum amount of heat. In one embodiment, steam loop 32 is operated as a closed loop system during this time by closing all of the valves 40. In another embodiment, all of the valves except the one farthest from the surface remain closed until a desired event occurs. Then that valve closes, and the rest of the valves open. In this embodiment, a single tubing string could be used to convey the steam downhole to the one open valve, and the wellbore casing/liner could be used to convey condensate back to the surface. The condensate could be cleaned and re-used by re-heating it using a heat exchanger and/or an inexpensive boiler. Using a single tubing string may be less expensive than using multiple tubing strings with packers therebetween. Recirculating the condensate and waiting until wellbore 34 has reached a predetermined temperature before injecting steam into the wellbore conserves energy and thus reduces the operation costs of the loop system. In addition, this method prevents the injection of excessive water into the formation that would eventually be produced and thus would have to be separated from the oil for disposal or reuse.

As in the embodiment shown in FIG. 1A, steam loop 32 may be switched from a closed loop mode to an injection mode manually or automatically (i.e. when valves 40 are thermally-controlled valves) in response to measured or sensed parameters. For example, a downhole temperature, a temperature of the steam/condensate in wellbore 34, a temperature of the produced oil, and/or the amount of condensate could be measured, and valves 40 could be adjusted in response to such measurements. The same methods described previously may be employed to take the measurements. A control loop (e.g., intelligent well completions or smart wells) may be utilized to implement the switching of steam loop 32 from a closed loop mode to an injection mode and vice versa.

In the injection mode, near-saturated steam may be selectively injected into the heating zones of subterranean formation 36 by controlling valves 40. Valves 40 may regulate the flow of steam into wellbore 34 based on the temperature in the corresponding heating zones of subterranean formation 36. That is, valves 40 may open or increase the flow of steam into corresponding heating zones when the temperature in those heating zones is lower than desired. However, valves 40 may close or reduce the flow of steam into corresponding heating zones when the temperature in those heating zones is higher than desired. The opening and closing of valves 40 may be automated or manual in response to measured or sensed parameters as described above. As such, valves 40 can be controlled to achieve a substantially uniform temperature distribution across subterranean formation 36 such that all or a substantial portion of the oil in formation 36 is heated. In an embodiment, valves 40 comprise TCV's that automatically open or close in response to the temperature in a given heating zone. Additional details regarding such an embodiment are disclosed in the copending TCV application referenced previously.

Further, valves 40 may comprise steam traps that allow the steam to flow into wellbore 34 while inhibiting the flow of condensate into wellbore 34. Instead, the condensate may be returned from wellbore 34 back to steam boiler 30 via condensate return conduit 33, allowing it to be re-heated to form a portion of the steam flowing into wellbore 34. Removing the condensate from steam injection conduit 31 such that it is not released with the steam into wellbore 34 eliminates water logging and improves the quality of the steam. The quality of the steam injected into wellbore 34 can be adjusted by controlling the steam pressure and temperature of the entire system, or the quality of the steam injected into each heating zone of subterranean formation 36 may be adjusted by changing the temperature and pressure set points of the control valves 40. Injecting a higher quality steam into wellbore 34 provides for better heat transfer from the steam to the oil in subterranean formation 36. Further, the steam has enough stored heat to convert a portion of the condensed steam and/or flash near wellbore 34 into steam. Therefore, the amount of heat transferred from the steam to the oil in subterranean formation 36 is sufficient to render the oil mobile.

In alternative embodiments, steam loop 32 is a closed loop that releases thermal energy but not mass into wellbore 34. The steam loop 32 either contains no control valves, or the control valves 40 are closed such that steam is circulated rather than injected into wellbore 34. As the steam passes through steam injection conduit 31, heat may be transferred from the steam into the different zones of wellbore 34 and is further transferred into corresponding heating zones of subterranean formation 36.

In response to being heated by the steam circulated into wellbore 34, the oil residing in the adjacent subterranean formation 36 becomes less viscous such that gravity pulls it down to wellbore 34 where it can be produced. Also, any tar sand present in subterranean formation becomes less viscous, allowing oil to flow into wellbore 34. The oil that migrates into wellbore 34 may be recovered by pumping it through oil recovery conduit 42 to oil tank 46. Optionally, released deposits such as sand may also be removed from subterranean formation 36 by pumping the deposits from wellbore 34 via oil recovery conduit 42 along with the oil. The deposits may be separated from the oil in the manner described previously.

Figure 3A:
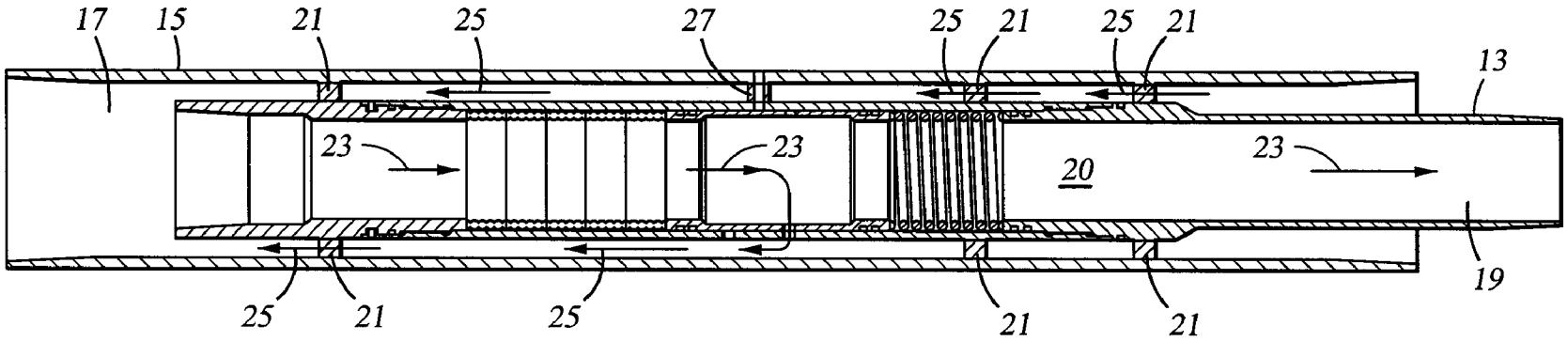
FIG. 3A depicts another embodiment of a portion of the loop system originally depicted in FIG. 1A, wherein a steam delivery conduit and a condensate recovery conduit are arranged in a concentric configuration.

It is understood that other configurations of the steam loop than those depicted in FIGS. 1A, 1B, 2A and 2B may be employed. For example, a concentric conduit configuration, a multiple conduit configuration, and so forth may be used. FIG. 3A illustrates another embodiment of the steam loop 12 (originally depicted in FIG. 1) arranged in a concentric conduit configuration. In this configuration, the steam injection conduit 13 is disposed within the condensate recovery conduit 15. Supports 21 may be interposed between condensate recovery conduit 15 (i.e., the outer conduit) and steam injection conduit 13 (i.e., the inner conduit) for positioning steam injection conduit 13 near the center of condensate recovery conduit 15. In addition, the section of steam injection conduit 13 shown in FIG. 3A includes a TCV 20 for controlling the flow of steam into the wellbore and the flow of condensate into condensate recovery conduit 15. A conduit 27 through which steam can flow when allowed to do so by TCV 20 extends from steam injection conduit 13 through condensate recovery conduit 15. As indicated by arrows 23, steam 23 is conveyed into the wellbore in an inner passageway 19 of the steam injection conduit 13. When the steam is below a set point temperature, TCV 20 may allow it to flow into condensate recovery conduit 15, as shown in FIG. 3A. As indicated by arrows 25, condensate 25 that forms from the steam is then pumped back to the steam boiler (not shown) through an inner passageway 17 of condensate recovery conduit 15. Additional disclosure regarding the use and operation of the TCV can be found in aforementioned copending TCV application.

Figure 3B:
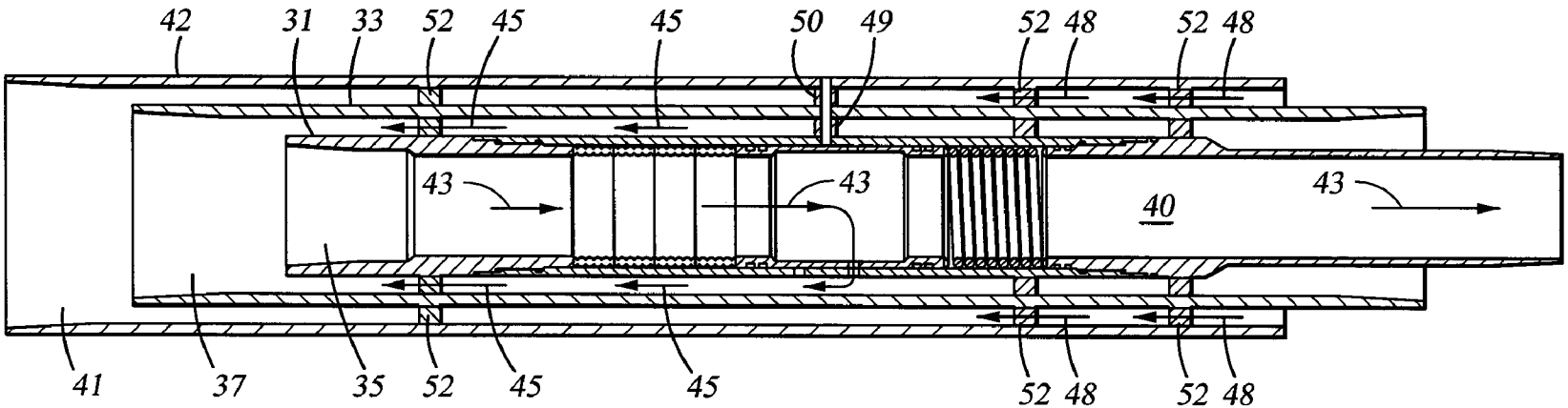
FIG. 3B depicts another embodiment of a portion of the loop system originally depicted in FIG. 2A, wherein a steam delivery conduit, a condensate recovery conduit, and an oil recovery conduit are arranged in a concentric configuration.

In addition, FIG. 3B illustrates another embodiment of steam loop 32 (originally depicted in FIG. 2) arranged in a concentric conduit configuration. In this configuration, the steam injection conduit 31 is disposed within the condensate recovery conduit 33, which in turn is disposed within recovery conduit 42. Supports 52 may be interposed between oil recovery conduit 42 (i.e., the outer conduit) and condensate recovery conduit 33 (i.e., the middle conduit) and between condensate recovery conduit 33 and steam injection conduit 31 (i.e., the inner conduit) for positioning condensate recovery conduit 33 near the center of oil recovery conduit 42 and steam injection conduit 31 near the center of condensate recovery conduit 33. In addition, the section of steam injection conduit 31 shown in FIG. 3B includes a TCV 40 for controlling the flow of steam into the wellbore and the flow of condensate into condensate recovery conduit 33. Conduits 49 and 50 through which steam can flow when allowed to do so by TCV 40 extend from steam injection conduit 31 through condensate recovery conduit 33 and from condensate recovery conduit 33 through oil recovery conduit 42, respectively. As indicated by arrows 43, steam 23 is conveyed into the wellbore in an inner passageway 35 of steam injection conduit 31. When the steam is below a set point temperature, TCV 40 may allow it to flow into condensate recovery conduit 33, as shown in FIG. 3B. As indicated by arrows 45, condensate that forms from the steam is then pumped back to the steam boiler (not shown) through an inner passageway 37 of condensate recovery conduit 33. Suitable pumps for performing this task have been described previously. When the oil in the subterranean formation adjacent to the steam, loop becomes heated by the steam, it may flow into and through an inner passageway 41 of oil recovery conduit 42 to an oil tank (not shown), as indicated by arrows 48. Additional disclosure regarding the use and operation of the TCV can be found in the aforementioned copending TCV application.

Figure 4:
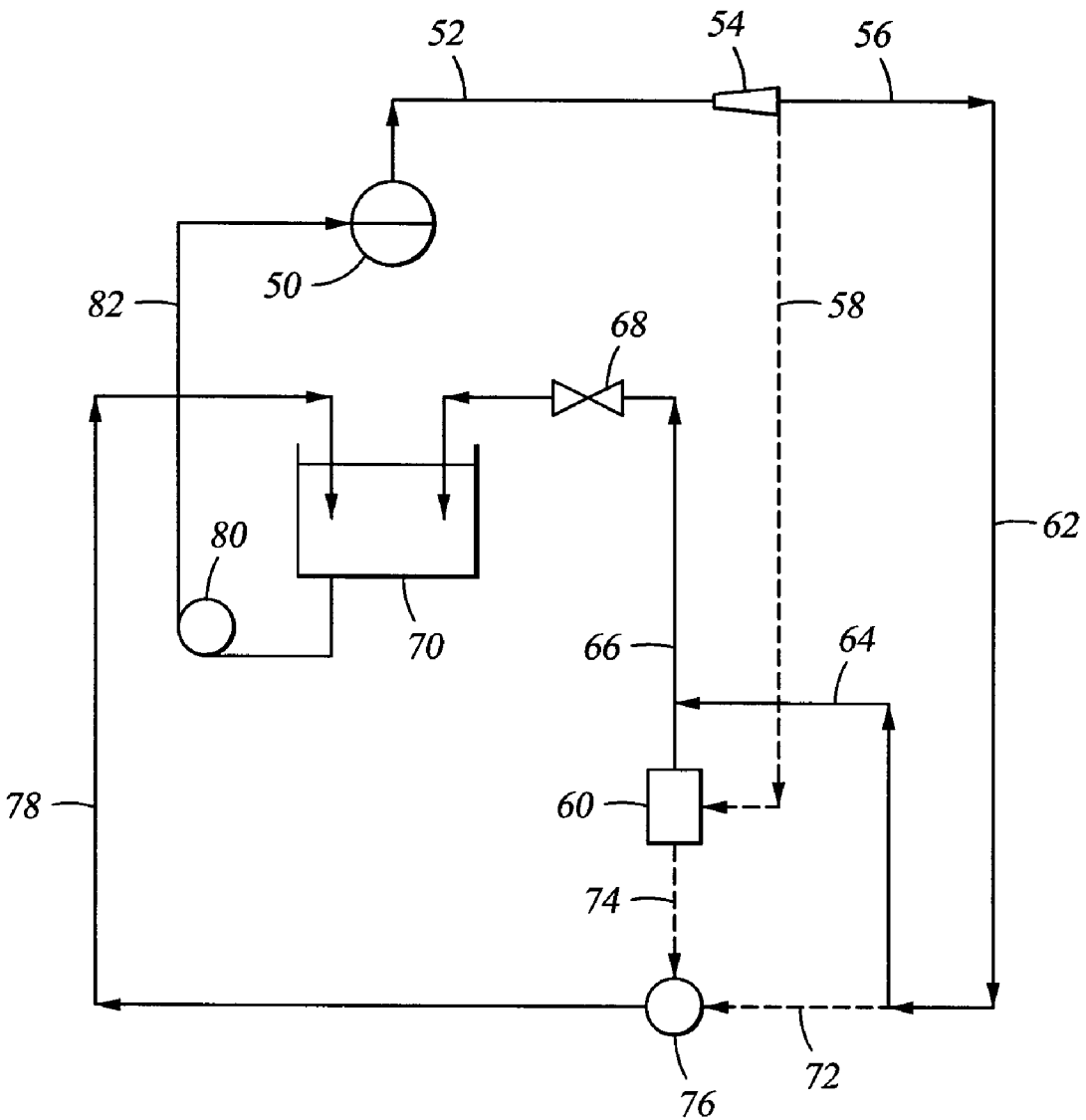
FIG. 4 depicts an embodiment of a steam loop that may be used in the embodiments shown in FIG. 1A and FIG. 2A.

Turning to FIG. 4, an embodiment of a steam loop is shown that may be employed in the loop systems depicted in FIGS. 1 and 2. The steam loop includes a steam boiler 50 that produces a steam stream 52 having a relatively high pressure and high temperature. Steam boiler 50 may be located above the earth's surfaces, or alternatively, it may be located underground. The boiler 50 may be fired using electricity or with hydrocarbons, e.g., gas or oil, recovered from the injection of steam or from other sources (e.g. pipeline or storage tank). The steam stream 52 recovered from steam boiler 50 may be conveyed to a steam trap 54 that removes condensate from steam stream 52, thereby forming high pressure steam stream 56 and condensate stream 58. Steam trap 54 may be located above or below the earth's surface. Additional steam traps (not shown) may also be disposed in the steam loop. Condensate 58 may then be conveyed to a flash tank 60 to reduce its pressure, causing its temperature to drop quickly to its boiling point at the lower pressure such that it gives off surplus heat. The surplus heat may be utilized by the condensate as latent heat, causing some of the condensate to re-evaporate into flash-steam. This flash-steam may be used in a variety of ways including, but not limited to, adding additional heat to steam in the steam injection conduit, powering condensate pumps, heating buildings, and so forth. In addition, this steam may be passed to a feed tank 70 via return stream 66, where its heat is transferred to the makeup water by directly mixing with the makeup water or via heat exchanger tubes (not shown). The flash tank 60 may be disposed below the surface of the earth in close proximity to the wellbore. Alternatively, it may be disposed on the surface of the earth. The feed tank 70 may be disposed on or below the surface of the earth. Condensate recovered from flash tank 60 may be conveyed to a condensate pump 76 disposed in the wellbore or on the surface of the earth. Although not shown, make-up water is typically conveyed to feed tank 70.

As high pressure steam stream 56 passes into the wellbore, the pressure of the steam decreases, resulting in the formation of low pressure steam stream 62. Condensate present in low pressure steam stream 62 is allowed to flow in a condensate stream 72 to condensate pump 76 disposed in the wellbore or on the surface of the earth. The condensate pump 76 then displaces the condensate to feed tank 70 via a return stream 78. In an embodiment, a downhole flash tank (not shown) may be disposed in condensate stream 72 to remove latent heat from the high-pressure condensate downhole (where the heat can be used) before pumping the condensate to feed tank 70. A steam stream 64 from which the condensate has been removed also may be conveyed to a feed tank 70 via return stream 66. A thermostatic control valve 68 disposed in return stream 66 regulates the amount of steam that is injected or circulated into the feed tank. The water residing in feed tank 70 may be drawn therefrom as needed using feed pump 80, which conveys a feed stream of water 82 to steam boiler 50, allowing the water to be re-heated to form steam for use in the wellbore.

In some embodiments, it may be desirable to inject certain oil-soluble, oil-insoluble, miscible, and/or immiscible fluids into the subterranean formation concurrent with injecting the steam. In an embodiment, the oil-soluble fluids are recovered from the subterranean formation and subsequently re-injected therein. One method of injecting the oil-soluble fluids comprises pumping the fluid down the steam injection conduit while or before pumping steam down the conduit. The production of oil may be stopped before injecting the oil-soluble fluid into the subterranean formation. Alternatively, the steam may be injected into the subterranean formation before injecting the oil-soluble fluid therein. The injection of steam is terminated during the injection of the oil-soluble fluid into the subterranean formation and is then re-started again after completing the injection of the oil-soluble fluid. This cycling of the oil-soluble fluid and the steam into the subterranean formation can be repeated as many times as necessary. Examples of suitable oil-soluble fluids include carbon dioxide, produced gas, flue gas (i.e., exhaust gas from a fossil fuel burning boiler), natural gas, hydrocarbons such as naphtha, kerosene, and gasoline, and liquefied petroleum products such as ethane, propane, and butane.

According to some embodiments, the presence of scale and other contaminants may be reduced by pumping an inhibitive chemical into the steam loop for application to the conduits and devices therein. Suitable substances for. the inhibitive chemical include acetic acid, hydrochloric acid, and sulfuric acid in sufficiently low concentrations to avoid damage to the loop system. Examples of other suitable inhibitive chemicals include hydrocarbons such as naphtha, kerosene, and gasoline and liquefied petroleum products such as ethane, propane, and butane. In addition, various substances may be pumped into the steam loop to increase boiler efficiency though improved heat transfer, reduced blowdown, and reduced corrosion in condensate lines. Examples of such substances include alkalinity builders, oxygen scavengers, calcium phosphate sludge conditioners, dispersants, anti-scalants, neutralizing amines, and filming amines.

The system hereof may also be employed for or in conjunction with miscellar solution flooding in which surfactants, such as soaps or soap-like substances, solvents, colloids, or electrolytes are injected, or in conjunction with polymer flooding in which the sweep efficiency is improved by reducing the mobility ratio with polysaccharides, polyacrylamides, and other polymers added to injected water or other fluid. Further, the system hereof may be used in conjunction with the mining or recovery of coal and other fossil fuels or in conjunction with the recovery of minerals or other substances naturally or artificially deposited in the ground.

A plurality of control valves are disposed in the wellbore and used to regulate the flow of the fluid into the wellbore, wherein the valves correspond to the heating zones such that the fluid may be selectively injected into the heating zones. The control valves may be disposed in a delivery conduit comprising a plurality of heating zones that correspond to the heating zones in the wellbore. The heating zones are isolated from each other by isolation packers. Examples of fluids that may be injected into the subterranean formation include, but are not limited to, steam, heated water, or combinations thereof.

The fluid may comprise, for example, steam, heated water, or combinations thereof. The loop system is also used to return the same or different fluid from the wellbore. The loop system comprises one or more control valves for controlling the injection of the fluid into the subterranean formation. Thus, the loop system can be automatically or manually switched from a closed loop system in which all of the control valves are closed to an injection system in which one or more of the control valves are regulated open to control the flow of the fluid into the subterranean formation.

The loop system described herein may be applied using other recovery methods deemed appropriate by one skilled in the art. Examples of such recovery methods include VAPEX (vapor extraction) and ES-SAGD (expanding solvent-steam assisted gravity drainage). VAPEX is a recovery method in which gaseous solvents are injected into heavy oil or bitumen reservoirs to increase oil recovery by reducing oil viscosity, in situ upgrading, and pressure control. The gaseous solvents may be injected by themselves, or for instance, with hot water or steam. ES-SAGD (Expanding Solvent-Steam Assisted Gravity Drainage) is a recovery method in which a hydrocarbon solvent is co-injected with steam in a gravity-dominated process, similar to the SAGD process. The solvent is injected with steam in a vapor phase, and condensed solvent dilutes the oil and, in conjunction with heat, reduces its viscosity.

While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim. Direction terms in this patent application, such as "left", "right", "upper", "lower", "above", "below", etc., are not intended to be limiting and are used only for convenience in describing the embodiments herein. Spatial terms in this patent application, such as "surface", "subsurface", "subterranean", "compartment", "zone", etc. are not intended to be limiting and are used only for convenience in describing the embodiments herein. Further, it is understood that the various embodiments described herein may be utilized in various configurations and in various orientations, such as slanted, inclined, inverted, horizontal, vertical, etc., as would be apparent to one skilled in the art.

Accordingly, the scope of protection is not limited by the description set out above, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method for servicing a wellbore penetrating a subterranean formation, comprising:

circulating a fluid through a loop system in the wellbore; wherein the loop system comprises a fluid injection conduit coupled to a condensate recovery conduit; and controllably releasing the fluid from the loop system into the subterranean formation to heat the subterranean formation; wherein the wellbore comprises a plurality of isolated heating zones along a singular steam injection conduit.

2. The method of claim 1, wherein the subterranean formation comprises a plurality of heating zones that are independently heated.

3. The method of claim 2, wherein at least one of the heating zones is isolated from the other heating zones.

4. The method of claim 2, wherein the heating zones create a substantially uniform temperature profile.

5. The method of claim 1, wherein the wellbore comprises a first heating zone and a second heating zone adjacent to the first heating zone; wherein fluid is released into a first heating zone without being released into the second heating zone.

6. The method of claim 1, further comprising: refraining from releasing the fluid until a lower predetermined temperature is reached.

7. The method of claim 1, further comprising: discontinuing the release of the fluid when an upper predetermined temperature is reached.

8. The method of claim 1, further comprising: refraining from releasing the fluid until a heating zone lower predetermined temperature is reached or discontinuing the release of the fluid when a heating zone a heating zone upper predetermined temperature is reached, wherein the determination whether the lower or upper predetermined temperature has been reached occurs within the wellbore.

9. The method of claim 1, wherein the fluid is not released into the wellbore until the fluid is substantially free of condensate.

10. The method of claim 1, wherein the fluid is only released into cold spots within the subterranean formation.

11. The method of claim 1, wherein the fluid is not released into hot spots within the subterranean formation.

12. The method of claim 1, wherein the subterranean formation has a temperature gradient.

13. The method of claim 1, wherein the amount of fluid released into the formation is dependent on the temperature of the subterranean formation.

14. The method of claim 1, wherein the amount of fluid released into the formation is dependent on the temperature of the fluid.

15. The method of claim 1, wherein a thermally controlled valve is used to control the release of the fluid into the wellbore.

16. The method of claim 1, wherein a valve releases the fluid into the wellbore without a control signal, power input, or external mechanical actuation.

17. The method of claim 1, wherein a plurality of valves are used to control the release of the fluid, and wherein one of the valves releases the fluid while another valve simultaneously refrains form releasing the fluid.

18. The method of claim 17, wherein the wellbore comprises a plurality of heating zones; and wherein at least one valve is located in each of the heating zones.

19. The method of claim 1, wherein a brain controls the release of the fluid into the wellbore.

20. A system comprising:

a loop system disposed in a wellbore penetrating a subterranean formation, the loop system configured to circulate a fluid, wherein the loop system comprises a fluid injection conduity coupled to a condensate recovery conduit; and wherein the wellbore comprises a plurality of isolated heating zones along a singular steam injection conduit; and a valve located on the loop system, the valve configured to controllably release the fluid from the loop system to heat the subterranean formation.

21. A method for servicing a wellbore penetrating a subterranean formation, comprising:

circulating a fluid through a loop system in the wellbore;

controllably releasing the fluid from the loop system into the subterranean formation to heat the subterranean formation; wherein the wellbore comprises a plurality of isolated heating zones along a singular steam injection conduit; and collecting fluids from the subterranean formation in a conduit outside the wellbore.

* * * * *